US011517803B2

(12) United States Patent
Sun

(10) Patent No.: US 11,517,803 B2
(45) Date of Patent: Dec. 6, 2022

(54) HORSE-RIDING MACHINE WITH ROWING FUNCTION

(71) Applicant: Amoy YG Sports Technology Co., Ltd., Fujian (CN)

(72) Inventor: Yu Sun, Fujian (CN)

(73) Assignee: AMOY YG SPORTS TECHNOLOGY CO., LTD., Fujian (CN)

( * ) Notice: Subject to any disclaimer, the term of this patent is extended or adjusted under 35 U.S.C. 154(b) by 0 days.

(21) Appl. No.: 17/369,054

(22) Filed: Jul. 7, 2021

(65) Prior Publication Data

US 2022/0355173 A1 Nov. 10, 2022

(30) Foreign Application Priority Data

May 6, 2021 (CN) ..... 202120951082.3

(51) Int. Cl.
*A63B 69/04* (2006.01)
*A63B 21/068* (2006.01)

(52) U.S. Cl.
CPC ..... *A63B 69/04* (2013.01); *A63B 21/068* (2013.01)

(58) Field of Classification Search
CPC ..... A63B 69/04; A63B 21/068
See application file for complete search history.

(56) References Cited

U.S. PATENT DOCUMENTS

RE22,105 E * 6/1942 Marlowe ..... A63B 69/04 601/92
5,527,250 A * 6/1996 Chen ..... A63B 23/0429 482/52
5,584,785 A * 12/1996 Wu ..... A63B 21/068 482/57
5,658,227 A * 8/1997 Stearns ..... A63B 23/0405 482/57
5,672,142 A * 9/1997 Wu ..... A63B 22/0076 482/57
7,393,308 B1 * 7/2008 Huang ..... A63B 69/04 482/57
7,422,548 B1 * 9/2008 Teng ..... A63B 22/0012 482/57
7,981,010 B1 * 7/2011 Webber ..... A63B 21/159 482/137
2006/0172867 A1 * 8/2006 Lee ..... A63B 21/4047 482/57

(Continued)

*Primary Examiner* — Andrew S Lo
(74) *Attorney, Agent, or Firm* — Muncy, Geissler, Olds & Lowe, P.C.

(57) ABSTRACT

A horse-riding machine with rowing function includes a driven assembly hinged with a base assembly, one end of a moment arm is hinged with the driven assembly; an armrest of the driving assembly is provided at top of the main body rod, and the footrests are provided at a bottom of the main body rod. The bottom of the paddle rod is connected with the bottom of the main body rod, and the middle of the main body rod is hinged with the other end of the moment arm; when the driving assembly swings, the driven assembly is driven by the driving arm to swing back and forth through the moment arm; one end of the elastic rope is connected to the driven assembly, and the other end of the elastic rope is detachably fixed on the base assembly. When the driven assembly swings, the elastic rope is elastically stretched.

10 Claims, 6 Drawing Sheets

(56) References Cited

U.S. PATENT DOCUMENTS

| | | | | |
|---|---|---|---|---|
| 2007/0161467 | A1* | 7/2007 | Lee | A63B 69/04<br>482/57 |
| 2007/0238586 | A1* | 10/2007 | Fan | A63B 69/04<br>482/64 |
| 2015/0258407 | A1* | 9/2015 | Greenwood | A63G 13/06<br>482/146 |
| 2016/0001155 | A1* | 1/2016 | Chung | A63B 69/04<br>482/4 |
| 2019/0381350 | A1* | 12/2019 | I-Heng | A63B 21/0088 |

* cited by examiner

HORSE-RIDING MACHINE WITH ROWING FUNCTION

TECHNICAL FIELD

The present disclosure relates to the technical field of sports equipment, and in particular, to a horse-riding machine with rowing function.

BACKGROUND

Horse-riding machine is a common fitness equipment. The user sits on the equipment, supports the armrest with both hands, and pushes the feet forward to achieve the effect of fitness. When people sit on the cushions of the horse-riding machine, they can experience the artistic conception of riding a horse galloping in the wild. By changing the grip posture and foot position, and simulating the riding posture, 80% of the muscles in the body can be trained, and the joints of the whole body can be fully rotated and stretched. The rowing machine is a machine used to simulate water rowing for training purposes. It has a good effect on muscle strengthening of the legs, waist, upper limbs, chest and back. Especially for people with a lot of fat on the waist, abdomen and upper arms, rowing machine exercises can bring unexpected body shaping effects to users. Although rowing machines and horse-riding machines are both sports equipment, the body parts they focus on are different. The existing sports equipment cannot achieve the exercise effect of two simulated sports. The purchase of two types of equipment at the same time will undoubtedly cause problems such as increased costs and increased space.

SUMMARY

To this end, it is necessary to provide a horse-riding machine with rowing function to solve the problem that the existing horse-riding machine cannot achieve the exercise effect of a rowing machine and cannot be used in one machine.

A horse-riding machine with rowing function comprises: a base assembly, a driving assembly, a driven assembly, a moment arm, and at least one elastic rope;

both the driving assembly and the driven assembly are hinged with the base assembly, one end of the moment arm is hinged with the driven assembly; the driving assembly comprises a main body rod, an armrest, footrests and paddle rods; the armrest is provided on a top of the main body rod, and each footrest is provided at a bottom of the main body rod; a bottom of each paddle rod is connected with the bottom of the main body rod, a middle of the main body rod is hinged with an other end of the moment arm;

when the driving assembly swings, the driven assembly is driven by the driving assembly through the moment arm to swing back and forth; one end of the elastic rope is fixed to the driven assembly, an other end of the elastic rope is detachably fixed to the base assembly; when the driven assembly swings, the elastic rope is elastically stretched.

Wherein, in order to make the main body rod stretchable to adapt to users of different body shapes and habits, and to facilitate the setting of pedals and paddle rods, and to facilitate the user's effort, the main body rod includes a U-shaped rod and a telescopic rod with an adjustable length; the U-shaped rod is fixed at a bottom position of the telescopic rod, the footrest and the bottom of the paddle rod are provided on the U-shaped rod, and the armrest is fixed at a top of the telescopic rod.

Wherein, in order for the user to adjust the position of the paddle rod on both sides when simulating a boating, so as to facilitate the use of users of different body shapes and habits, the U-shaped rod is provided with a protrusion respectively at two sides, and each protrusion is hinged with a paddle rod, the paddle rod is capable to swing and adjust to the two sides of the U-shaped rod around the protrusion.

Wherein, in order to be able to set the exercise intensity of multiple gears to facilitate users with different needs, a plurality of elastic ropes are provided, one end of each of the elastic ropes is fixed to the driven assembly, and the other end of the each of the elastic ropes is detachably fixed on the base assembly.

Wherein, in order to conveniently store the removed elastic rope when the exercise intensity is adjusted, the driven assembly is provided with a connector, one end of the elastic rope is fixed to the driven assembly, and the other end of the elastic rope is detachably fixed on the connector or on the base assembly.

Wherein, in order to conveniently switch and adjust the strength gear of the horse-riding machine, both the driven assembly and the base assembly are provided with hooks, and one end of the elastic rope is fixed to the driven assembly, the other end of the elastic rope is fixed to the connector or on the base assembly through the hook.

Wherein, in order to change the direction of the elastic rope and guide it when the driven assembly swings, the bottom of the driven assembly is fixedly connected with a pulley; the elastic rope is provided in a groove of the pulley, and when the driven assembly swings, a extension direction of the elastic rope is changed by the pulley.

Wherein, in order to protect the elastic rope from being interfered during work and ensure its normal operation, the elastic rope is provided at the bottom of the driven assembly, and the bottom of the driven assembly is fixed with a hollow protector made of a hard material; the elastic rope is provided in the protector.

Wherein, in order to adapt to users of different body shapes and different sports needs, the base assembly comprises an adjusting part; the adjusting part is provided under the driven assembly and supports and jacks up the driven assembly, and then a height of the driven assembly is adjusted by adjusting a length of the adjusting part.

Wherein, in order to adapt to users of different body shapes and different sports needs, the driven assembly is provided with a seat cushion, the driven assembly is provided with a plurality of mounting holes, and the seat cushion is detachably installed on the mounting holes.

In the technical scheme of the present disclosure, at least one elastic rope is provided between the driven assembly and the base assembly, and the connection between the elastic rope and the base assembly is set as a detachable connection. When in use, the user moves the driving assembly and drives the driven assembly to move through the moment arm, thereby achieving the effect of exercise. In addition to the armrests and footrests (pedals) used to simulate horse-riding, the driving assembly is also equipped with paddle rods. When the user holds the armrests while stepping on the pedals, he can imitate the horse-riding movement; when the user holds the paddle rods while the stepping on the pedals, he can imitate the rowing motion, such that a machine with dual purposes can be realized. The equipment has the effect of riding and rowing, can effectively exercise the lower body, upper body, abdomen and heart, and can effectively enhance the cardiopulmonary function and the coordination of hands and feet.

Figure 1:
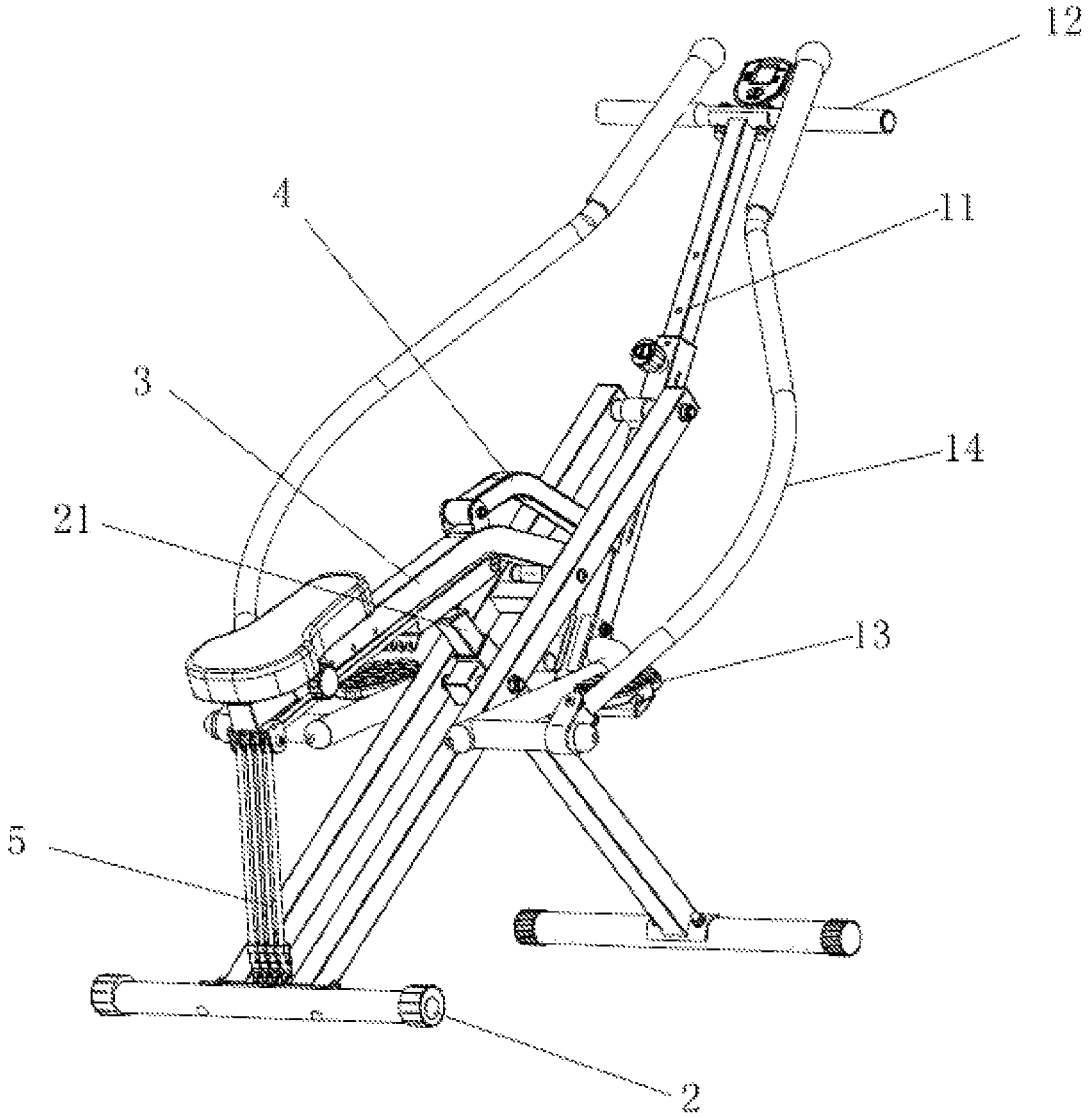
FIG. 1 is a schematic structural view showing a horse-riding machine with rowing function according to an embodiment of the present disclosure.
Figure 2:
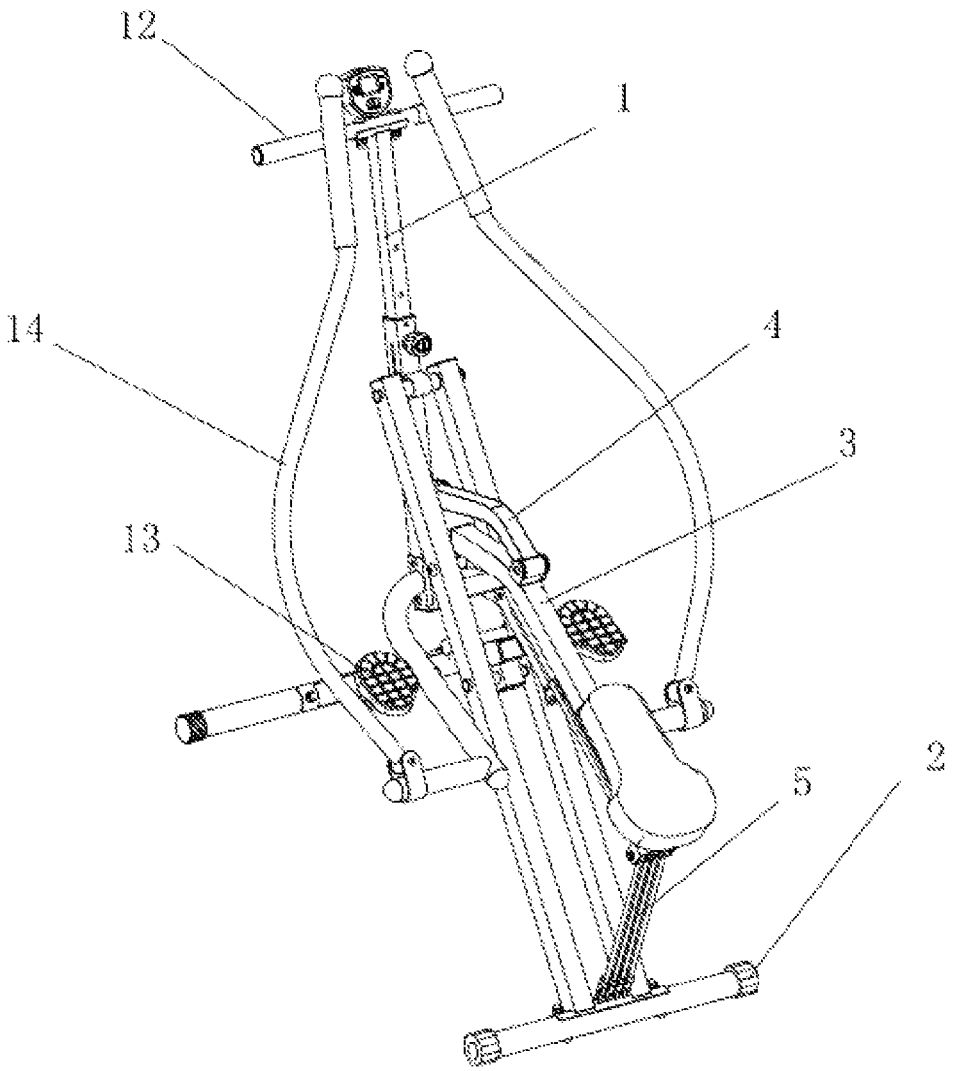
FIG. 2 is a schematic structural view from another angle showing a horse-riding machine with rowing function according to an embodiment of the present disclosure.
Figure 3:
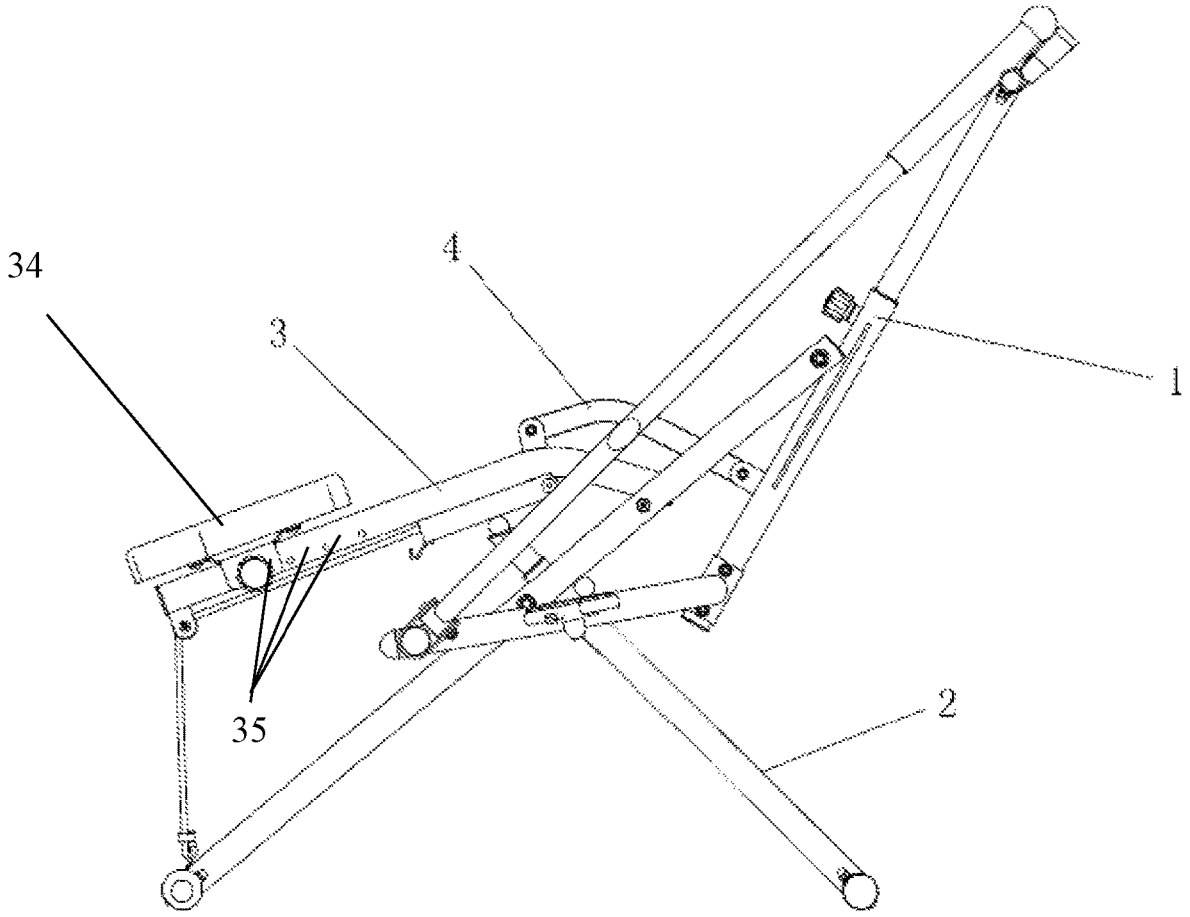
FIG. 3 is a front view showing a horse-riding machine with rowing function according to an embodiment shown in FIG. 1.
Figure 4:
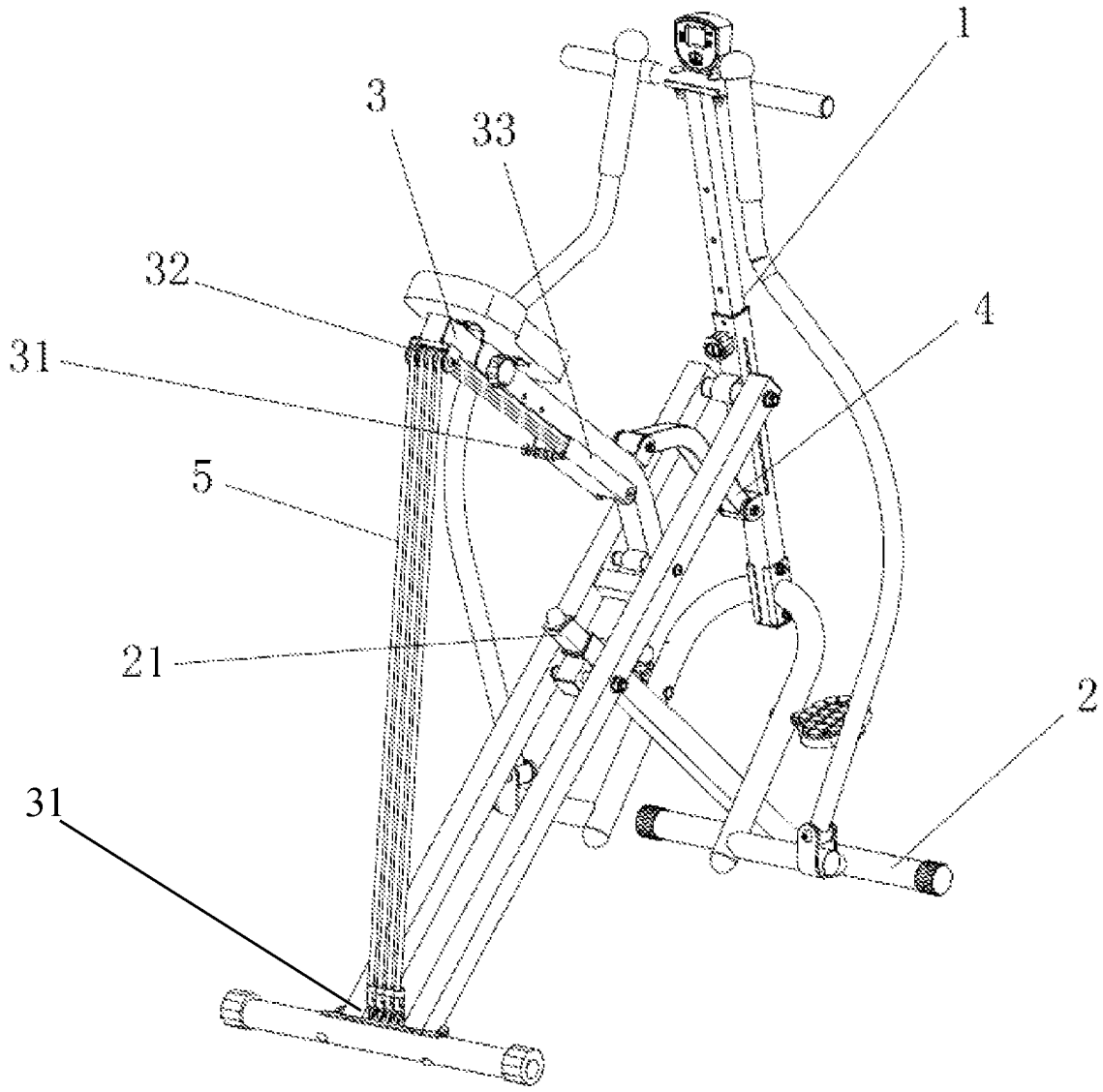
FIG. 4 is a schematic structural diagram showing a horse-riding machine with rowing function according to an embodiment of the present disclosure in the stretched state of the elastic rope.

In the drawings, the list of parts represented by each number is as follows:

1, driving assembly; 11, main body rod; 111, U-shaped rod; 112, telescopic rod; 113, protrusion; 12, armrest; 13, footrest (or pedal); 14, paddle rod;

2, base assembly; 21, adjusting part;

3, driven assembly; 31, hook; 32, pulley; 33, protector;

4, moment arm;

5. elastic rope.

DESCRIPTION OF EMBODIMENTS

In order to make the above objectives, features and advantages of the present disclosure more obvious and easy to understand, the following describes the specific implementation of the present disclosure clearly and completely with reference to the accompanying drawings. Obviously, the specific details described below are only a part of the embodiments of the present disclosure, and the present disclosure can also be implemented in many other embodiments different from those described herein. Based on the embodiments of the present disclosure, all other embodiments obtained by those of ordinary skill in the art without inventive work shall fall within the protection scope of the present disclosure.

It should be noted that when an element is referred to as being "fixed to" another element, it can be directly on the other element or an intermediate element may also be present. When an element is considered to be "connected" to another element, it can be directly connected to the other element or an intermediate element may be present at the same time. The terms "vertical", "horizontal", "left", "right" and similar expressions used herein are for illustrative purposes only, and do not mean that they are the only embodiments.

Unless otherwise defined, all technical and scientific terms used herein have the same meaning as commonly understood by those skilled in the technical field of the present disclosure. The terminology used in the description of the present disclosure herein is only for the purpose of describing specific embodiments, and is not intended to limit the present disclosure.

In an embodiment, please refer to FIGS. 1 to 4, a horse-riding machine with rowing function may include a base assembly 2, a driving assembly 1, a driven assembly 3, a moment arm 4, and at least one elastic rope 5. The driving assembly 1 and the driven assembly 3 may be hinged to the base assembly 2, and one end of the moment arm 4 may be hinged to the driven assembly 3. The driving assembly 1 may include a main body rod 11, armrests 12, footrests 13 and a paddle rod 14, and the armrest 12 may be provided at the top of the main body rod 11, the footrest 13 may be provided at the bottom of the main body rod 11, the bottom of the paddle rod 14 may be connected to the bottom of the main body rod 11, and the middle part of the main body rod 11 may be hinged with the other end of the moment arm 4. When the driving assembly 1 swings, the driven assembly 3 may be driven to swing back and forth by the driving assembly 1 through the moment arm 4; one end of the elastic rope 5 may be fixed to the driven assembly 3, and the other end of the elastic rope 5 may be detachably fixed to the base assembly 2. When the driven assembly 3 swings, the elastic rope 5 may be elastically stretched.

In the technical solution of the present disclosure, at least one elastic rope 5 may be provided between the driven assembly 3 and the base assembly 2, and the connection between the elastic rope 5 and the base assembly 2 may be set as a detachable connection. When in use, the user moves the driving assembly 1 and drives the driven assembly 3 through the moment arm 4 to move, thereby achieving the effect of exercise. In addition to the armrest 12 and footrest 13 used to simulate horse-riding, the driving assembly 1 may be also provided with a paddle rod 14. When the user holds the armrests 12 while stepping on the footrests 13, the horse-riding movement can be imitated; when the paddle rods 14 is stepped on the pedals at the same time, the boating motion can be imitated, and a machine can be used for two purposes. The equipment has the effect of riding and rowing, can effectively exercise the lower body, upper body, abdomen and heart, and can effectively enhance the cardiopulmonary function and the coordination of hands and feet.

Figure 5:
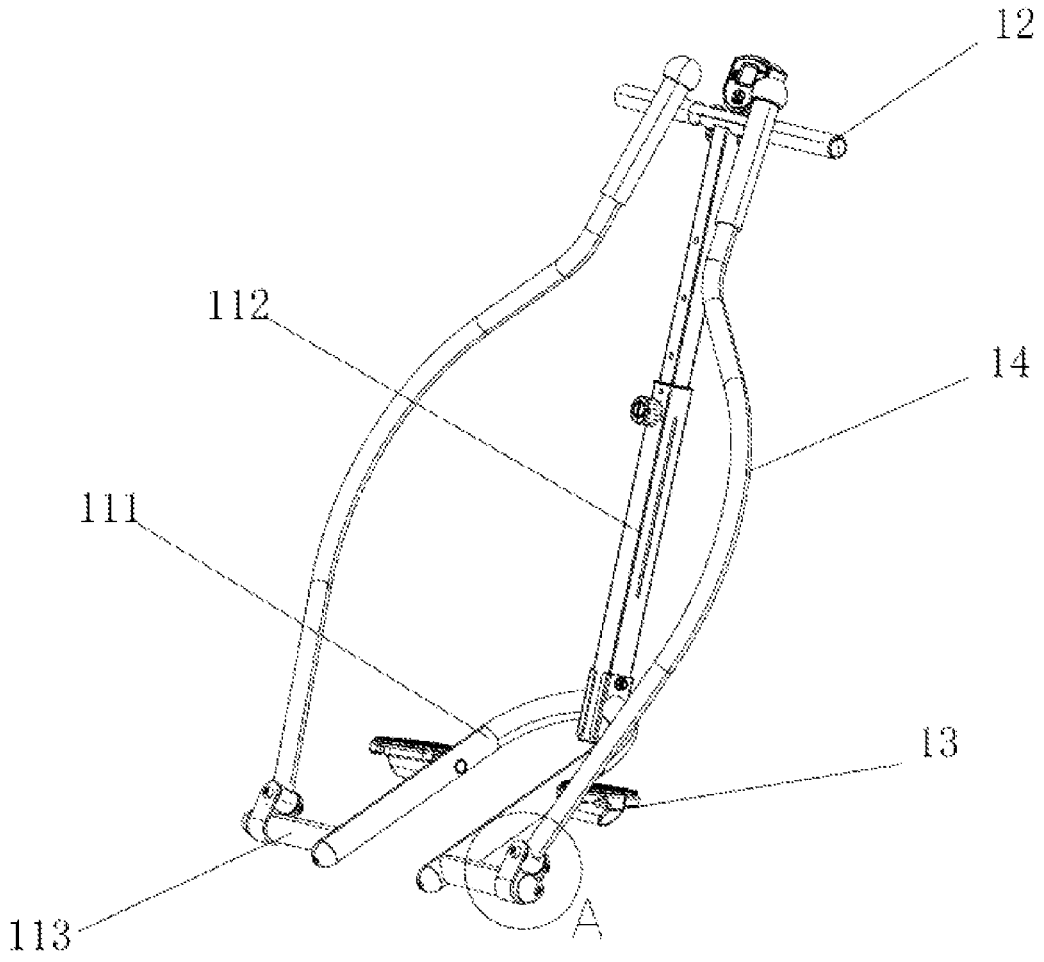
FIG. 5 is a schematic view showing a structure of the driving assembly part of a horse-riding machine with rowing function according to an embodiment of the present disclosure.
Figure 6:
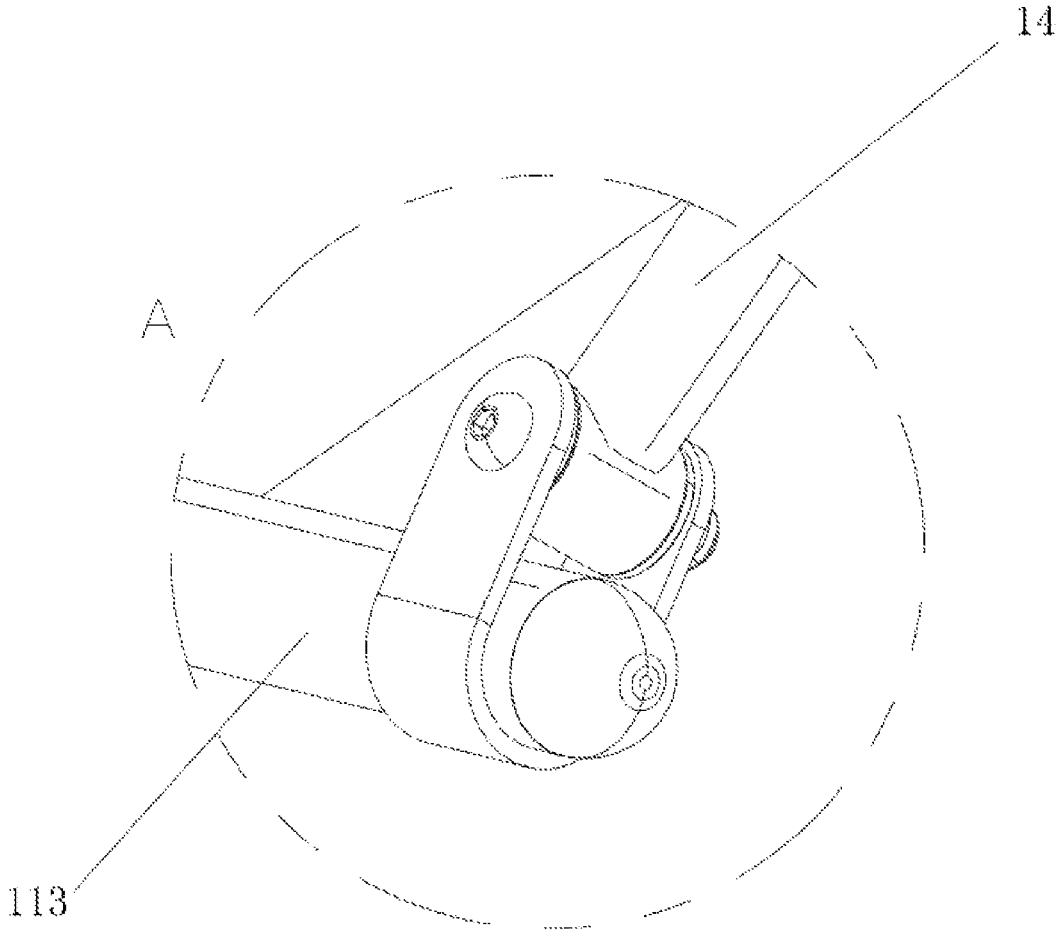
FIG. 6 is a partial enlarged schematic diagram of part A in FIG. 5 showing a horse-riding machine with rowing function according to an embodiment of the present disclosure.

Referring to FIGS. 5 and 6, in order to make the main body rod 11 stretchable to adapt to users of different body shapes and habits, and to facilitate the setting of the footrests 13 and the paddle rod 14 to facilitate the user's exertion, the main body rod 11 may include a U-shaped rod 111 and a telescopic rod 112 with an adjustable length. The U-shaped rod 111 may be fixed at the bottom of the telescopic rod 112, the bottom of the pedal 13 and the paddle rod 14 may be provided on the U-shaped rod 111, and the armrests 12 may be fixed on the top of the telescopic rod 112.

Among them, in order for the user to adjust the position of the paddle rod 14 to both sides when simulating boating, so as to facilitate the use of users of different body shapes and habits, a protrusion 113 may be provided respectively on both sides of the U-shaped rod 111, and each protrusion 113 may be respectively hinged to a paddle rod 14. The paddle rod 14 can swing around the protrusion 113 to the two sides of the U-shaped rod 111 for adjustment. In this embodiment, the top of the paddle rod 14 may be provided with a handle. The paddle rod 14 may be an arc-shaped curved rod that curves to the side. When in use, the user holds the handle of the paddle rod 14 and at the same time pedals 13 is stepped with his feet to row, such that simulation of rowing actions can be realized. Of course, the shape of the paddle rod 14 may also be a straight rod and other forms, which are not limited by the description in this embodiment.

In this embodiment, in order to be able to set the exercise intensity of multiple gears to facilitate users with different needs, a plurality of the elastic ropes 5 may be provided, and one end of each elastic rope 5 may be fixed to the driven assembly 3, and the other end of each elastic rope 5 may be detachably fixed to the base assembly 2.

It should be noted that the setting of the plurality of elastic ropes 5 can set the exercise intensity of multiple gears, which may be convenient for users with different needs. The user can remove a certain number of elastic ropes from the base assembly 2 to reduce the swing resistance of the driven assembly 3. The setting of the connector on the driven assembly 3 can conveniently accommodate the removed elastic rope when the exercise intensity is adjusted.

Further, in order to conveniently store the removed elastic rope when adjusting the exercise intensity, the driven assembly 3 may be provided with a connector. One end of the elastic rope 5 may be fixed to the driven assembly 3, and the other end of the elastic rope 5 can be detachably fixed on the connector or on the base assembly 2. Of course, the connector can also be realized by other detachable structures, such as detachable buckles, binding and winding, etc.

Specifically, in order to conveniently switch and adjust the strength of the horse-riding machine's gear, both the driven assembly 3 and the base assembly 2 may be provided with hooks 31. One end of the elastic rope 5 may be fixed to the driven assembly 3, and the other end of the elastic rope 5 may be fixed to connector or base assembly 2 through the hooks 31.

Wherein, in order to change the direction of the elastic rope 5 and guide it when the driven assembly 3 swings, a pulley 32 may be fixedly connected to the bottom of the driven assembly 3. The elastic rope 5 may be provided in a groove of the pulley 32, and when the driven assembly 3 swings, the pulley 32 changes the extension direction of the elastic rope 5. Of course, the pulley 32 can also be implemented by other structures such as a slider fixed to the bottom of the driven assembly 3.

Among them, in order to protect the elastic rope 5 from being interfered during work and ensure its normal operation, the elastic rope 5 may be provided at the bottom of the driven assembly 3, and the bottom of the driven assembly 3 may be fixed with a hollow protector 33 made of a hard material. The elastic rope 5 may be provided in the protector 33. In this embodiment, the protector 33 may be realized by using a hollow square steel bar. Of course, the structure can also be in other forms, which are not limited by the description in this embodiment.

Specifically, the base assembly 2 may include an adjusting part 21. The adjusting part 21 may be disposed under the driven assembly 3 and supports and lifts the driven assembly 3, and then adjusts the height of the driven assembly 3 by adjusting the length of the adjusting part 21. The height adjustment of the driven assembly 3 can be adapted to users with different body shapes and different sports needs. When in use, the length of the adjusting part 21 may be adjusted and locked by locking the buckle, and the driven assembly 3 may be lifted up to achieve the adjustment function of the height of the driven assembly 3.

It can be understood that the protector 33 may be disposed at the bottom position of the driven assembly 3, and the adjusting part 21 abuts against it, and then the driven assembly 3 may be lifted up.

Among them, in order to adapt to users of different body shapes and different sports needs, the driven assembly 3 may be provided with a seat cushion 34. The driven assembly 3 may be provided with a plurality of mounting holes 35, and the cushion may be detachably installed on the mounting holes.

In this embodiment, in order to facilitate the swing of the driving assembly 1 and facilitate it to drive the driven assembly 3 to perform work, the driving assembly 1 and the base assembly 2 may be rotatably connected. The driving assembly 1 and the base assembly 2 may be rotationally connected by hinge connection.

On the basis of this embodiment, further, the driven assembly 3 may be a metal rod, the first end of the metal rod may be bent and extended to one side. The metal rod may be hinged to the driving assembly 1 through the first end, and the second end of the metal rod may be provided with a pulley 32 at the bottom. The driven assembly 3 may be provided with a seat cushion 34, and the driven module 3 may be provided with a plurality of mounting holes 35, and the seat cushion 34 may be detachably mounted on the mounting holes 35. The adjustable seat cushion 34 may be adapted for users of different body shapes and different sports needs, which is convenient for exercise.

In this embodiment, the moment arm 4 may be a metal rod with one end bent, and the bent end may be hinged to the driven assembly 3. The base assembly 2 may be in the shape of a "A" and may include two sets of support rods connected to each other. The bottom of each set of support rods may be provided with a friction part for increasing friction. The friction part can be made of rubber or plastic with friction textures.

It is understandable that the driving assembly 1, the driven assembly 3, and the base assembly 2 of the present disclosure can be made of other structures, as long as their functions can be realized, and they are not limited to the structures described in this embodiment.

The sports equipment with elastic rope resistance structure of the present disclosure has a simple structure, can quickly and conveniently adjust the sports gear. It is suitable for users of different body shapes and different strengths, and is beneficial to popularization. In addition to the armrests 12 and pedals 13 used for simulating horse-riding, the driving assembly 1 is also provided with paddle rods 14 which can simulate two actions of rowing and horse-riding, and it is a dual purpose machine.

The technical features of the above embodiments can be combined arbitrarily. In order to make the description concise, all possible combinations of the technical features in the above embodiments are not described. However, as long as there is no contradiction in the combination of these technical features, they should be considered as the range described in this specification.

The above examples only express several implementations of the present disclosure, and the description is relatively specific and detailed, but it should not be understood as a limitation on the scope of the present disclosure. It should be pointed out that for those of ordinary skill in the art, without departing from the concept of the present disclosure, several modifications, substitutions and improvements can be made, and these should be covered by the scope of protection of the present disclosure. Therefore, the scope of protection of the present disclosure should be subject to the claims.

What is claimed is:

1. A horse-riding exercise machine with rowing function, comprising: a base assembly, a driving assembly, a driven assembly, a moment arm, and at least one elastic rope;

wherein both the driving assembly and the driven assembly are hinged with the base assembly, one end of the moment arm is hinged with the driven assembly; the driving assembly comprises a main body rod, an armrest, footrests and paddle rods; the armrest is provided on a top of the main body rod, and each footrest is provided at a bottom of the main body rod; a bottom of each paddle rod is connected with the bottom of the main body rod, a middle of the main body rod is hinged with another end of the moment arm;

when the driving assembly swings, the driven assembly is driven by the driving assembly through the moment arm to swing back and forth; one end of the elastic rope is fixed to the driven assembly, another end of the elastic rope is detachably fixed to the base assembly; when the driven assembly swings, the elastic rope is elastically stretched.

2. The horse-riding exercise machine with rowing function according to claim 1, wherein the main body rod comprises a U-shaped rod and a telescopic rod with an adjustable length; the U-shaped rod is fixed at a bottom position of the telescopic rod, the footrest and the bottom of the paddle rod are provided on the U-shaped rod, and the armrest is fixed at a top of the telescopic rod.

3. The horse-riding exercise machine with rowing function according to claim 2, wherein the U-shaped rod is provided with a protrusion respectively at two sides of the U-shaped rod, and each protrusion is hinged with a paddle rod, the paddle rod is capable to swing and adjust to the two sides of the U-shaped rod around the protrusion.

4. The horse-riding exercise machine with rowing function according to claim 1, wherein a plurality of elastic ropes are provided, one end of each of the elastic ropes is fixed to the driven assembly, and the other end of each of the elastic ropes is detachably fixed on the base assembly.

5. The horse-riding exercise machine with rowing function according to claim 1, wherein one end of the elastic rope is fixed to the driven assembly, and the other end of the elastic rope is detachably fixed on the connector or on the base assembly.

6. The horse-riding exercise machine with rowing function according to claim 5, wherein both the driven assembly and the base assembly are provided with hooks, and one end of the elastic rope is fixed to the driven assembly, the other end of the elastic rope is fixed on the base assembly through the hook.

7. The horse-riding exercise machine with rowing function according to claim 1, wherein the bottom of the driven assembly is fixedly connected with a pulley; the elastic rope is provided in a groove of the pulley, and when the driven assembly swings, a extension direction of the elastic rope is changed by the pulley.

8. The horse-riding exercise machine with rowing function according to claim 1, wherein the elastic rope is provided at the bottom of the driven assembly, and the bottom of the driven assembly is fixed with a hollow protector; the elastic rope is provided in the protector.

9. The horse-riding exercise machine with rowing function according to claim 1, wherein the base assembly comprises an adjusting part; the adjusting part is provided under the driven assembly and supports and jacks up the driven assembly, and then a height of the driven assembly is adjusted by adjusting a length of the adjusting part.

10. The horse-riding exercise machine with rowing function according to claim 1, wherein the driven assembly is provided with a seat cushion, the driven assembly is provided with a plurality of mounting holes, and the seat cushion is detachably installed on the mounting holes.

* * * * *